US006902126B2

(12) United States Patent
Chen et al.

(10) Patent No.: US 6,902,126 B2
(45) Date of Patent: Jun. 7, 2005

(54) HYBRID TURBINE CLASSIFIER

(75) Inventors: Michael M. Chen, Naperville, IL (US); Jianrong Chen, Naperville, IL (US)

(73) Assignee: ALSTOM Technology Ltd, Baden (CH)

( * ) Notice: Subject to any disclaimer, the term of this patent is extended or adjusted under 35 U.S.C. 154(b) by 118 days.

(21) Appl. No.: 10/287,107

(22) Filed: Nov. 4, 2002

(65) Prior Publication Data

US 2004/0084556 A1 May 6, 2004

(51) Int. Cl.[7] ..... B02C 23/12
(52) U.S. Cl. ..... 241/79.1; 241/80
(58) Field of Search ..... 241/79.1, 80

(56) References Cited

U.S. PATENT DOCUMENTS

| | | | | |
|---|---|---|---|---|
| 4,523,721 A | | 6/1985 | Maliszewski et al. | 241/61 |
| 4,597,537 A | * | 7/1986 | Misaka et al. | 241/79.1 |
| 4,689,141 A | * | 8/1987 | Folsberg | 209/714 |
| 5,180,113 A | * | 1/1993 | Gehrke | 241/79.1 |
| 5,251,831 A | * | 10/1993 | Yoshida et al. | 241/79.1 |
| 5,605,292 A | | 2/1997 | Bunton | 241/79.1 |
| 5,657,877 A | | 8/1997 | Yoshida et al. | 209/303 |
| 5,873,156 A | | 2/1999 | Wark | 29/401.1 |
| 5,884,776 A | | 3/1999 | Piepho et al. | 209/714 |
| 5,957,300 A | | 9/1999 | Nardi et al. | 209/143 |
| 6,079,648 A | | 6/2000 | Eastman et al. | 241/119 |
| 6,257,415 B1 | | 7/2001 | Wark | 209/722 |

* cited by examiner

*Primary Examiner*—Lowell A. Larson
(74) *Attorney, Agent, or Firm*—Arthur E. Fournier, Jr.

(57) ABSTRACT

A hybrid turbine classifier for a coal pulverizer includes a cone disposed within the separator body of the pulverizer. The cone extends downwardly from a base to a frustum which forms an opening for depositing coal particles on the grinding table of the pulverizer. The outer surface of the cone and the separator body define an outer passage for coal/air flow, containing a mixture of smaller and larger coal particles, from the grinding table. A circular, first classifier cage disposed proximate to the base of the cone defines a circumferential passage between the outer passage and the cavity of the cone. The first classifier cage includes static, circumferentially-spaced vanes which direct the coal/air flow in a spiraling, circular flow path within the cavity. The flow path defines a first flow direction. A circular, second classifier cage is coaxially disposed within the first classifier cage. The second classifier cage includes a rotor which is rotatable around the axis and which defines a circumferential outlet from the cavity. The rotor has circumferentially-spaced blades directing the coal/air flow in a second flow direction opposite to the first flow direction. The vanes of the first classifier cage define a static vane angle selected to direct the coal/air flow tangentially to the blades of the second classifier cage.

3 Claims, 3 Drawing Sheets

HYBRID TURBINE CLASSIFIER

BACKGROUND OF THE INVENTION

This invention relates generally to a pulverizer bowl mill. More particularly, the present invention relates to apparatus for separating particles of coal of a certain fineness from larger particles of coal within a pulverizer bowl mill.

It has long been known in the prior art to provide apparatus for purposes of effecting the grinding or pulverizing of certain materials. More specifically, the prior art is replete with examples of various types of apparatus that have been used to effect such grinding of a multiplicity of materials. Coal is one such material wherein there is a need that it be ground to a particular fineness in order to render it suitable for the use in, for example, a coal-fired steam generating power plant.

One particular type of coal pulverizing apparatus, which is to be found in the prior art is an apparatus, most commonly referred to in the industry by the name bowl mill. The latter apparatus obtains its name by virtue of the fact that the pulverization, i.e., grinding, of the coal which takes place therein is effected on a grinding surface that in configuration bears a resemblance to a bowl. Reference may be had by way of exemplification to U.S. Pat. No. 3,465,971, and/or U.S. Pat. No. 4,002,299 for a teaching of the nature of the construction and the mode of operation of a prior art form of bowl mill that is suitable for use in a coal fired power generation system to effectuate the pulverization of the coal that is to be burned as fuel therein.

In a coal pulverizing apparatus of the type to which reference has been had hereinbefore, a primary classification is had within the bowl mill of the material, e.g., coal, that is being pulverized therewithin. As employed herein the term primary classification is intended to refer to the separation of pulverized material from the air in which such material is entrained. In particular, reference is had here to that separation of pulverized material, which occurs as a consequence of causing the air within which the pulverized material is entrained to follow a tortuous path through the bowl mill whereby in the course of changing directions of flow the larger of the particles of the pulverized material lose their momentum and are made to return to the surface of the grinding table whereat they are subjected to further pulverization. The means by which this separation is generally accomplished is by way of a static classifier, as shown in U.S. Pat. No. 5,873,156 for example, or a rotary classifier, as shown in U.S. Pat. No. 5,657,877 for example.

In a static classifier, the flow of primary air and coal particles entrained therein is directed through a series of stationary turning vanes which make up the aforesaid convoluted path. Said turning vanes are canted at an angle to the direction of the flow of the stream of primary air and coal particles so as to cause the coarsest (and therefore heaviest particles) to fall out of the primary air stream and return to the grinding table to suffer a second pulverizing action.

In a rotary classifier, the flow of primary air and coal particles entrained therein is directed through a series of vanes disposed as an inverted, truncated cone and revolving about the central vertical axis of the housing at a predetermined rotational velocity in a squirrel cage fashion. The vanes are canted at an angle to the direction of the flow of the stream of primary air and coal particles entrained therein so as to present to the stream a window through which the stream of primary air and coal particles may pass unimpeded. However, the rotational velocity of the vanes coupled with the velocity of the primary air stream and the coal particles entrained therein acts to separate the coal particles into two groups. A first group of particles are those that are relatively coarse or heavy and therefore unable to pass unimpeded through the aforesaid window and are thus returned to the grinding table to suffer a second pulverizing action. A second group of particles are those that are relatively fine or light and therefore able to pass unimpeded through the window and thus be directed through the remainder of the bowl mill and delivered to the furnace of the steam generator.

For a fixed velocity of the primary air stream, by the judicious manipulation and control of the aforesaid rotational velocity of the vanes, the relative fineness of the two groups of coal particles may be adjusted, i.e., by increasing the rotational velocity of the vanes, the fineness of the coal particles that pass through the aforesaid window increases. In other words only increasingly finer particles will pass unimpeded as rotational velocity increases whereas increasingly coarser coal particles will pass unimpeded as rotational velocity is reduced. Conversely, for a fixed rotational velocity of the vanes, by the judicious manipulation and control of the aforesaid velocity of the primary air stream, the relative fineness of the two groups of coal particles may be adjusted, i.e., by increasing the velocity of the primary air stream, the fineness of the coal particles that pass through the aforesaid window decreases. In other words coarser and coarser particles will pass unimpeded as primary air velocity increases and finer and finer coal particles will pass unimpeded as primary air velocity is reduced.

The operation of classifiers can be characterized by several important relationships. Firstly, the carbon loss suffered by a coal-fired steam generating power plant decays approximately exponentially with an increase in the fineness of the pulverized coal burned in the steam generator. Secondly, fineness declines approximately linearly with increasing throughput, with the performance of a rotary classifier an improvement upon that of a static classifier. In addition, by increasing the mass flow rate of primary air to the bowl mill, fineness decreases due to the fact that heavier and therefore larger coal particles can be adequately entrained by the primary air stream. Conversely, by decreasing the mass flow rate of primary air to the mill, fineness increases. Also, by increasing the rotational velocity of a rotary classifier, fineness increases. One possible reason for the increase in the fineness could be that there is now a smaller time interval available between the successive passage of the classifier vanes through which a particle of coal may pass. Conversely, by decreasing the rotational velocity of the rotary classifier, the fineness is decreased.

SUMMARY OF THE INVENTION

Briefly stated, the invention in a preferred form is a hybrid turbine classifier for a coal pulverizer which comprises a first cone disposed within the separator body of the pulverizer. The first cone extends downwardly from a base to a frustum which forms an opening for depositing coal particles on the grinding table of the pulverizer. The inner surface of the cone forms a cavity. The outer surface of the cone and the separator body define an outer passage for coal/air flow, containing a mixture of smaller and larger coal particles, from the grinding table. A circular, first classifier cage is disposed proximate to the base of the first cone. The first classifier cage defines an axis and a circumferential passage between the outer passage and the cavity of the first cone. The first classifier cage includes a plurality of static, circumferentially-spaced vanes which direct the coal/air flow in a spiraling, circular flow path within the cavity of the first cone. The flow path defines a first flow direction. A circular, second classifier cage is coaxially disposed within the first classifier cage. The second classifier cage includes a rotor which is rotatable around the axis and which defines a circumferential outlet from the cavity of the first cone. The rotor has a plurality of circumferentially-spaced blades directing the coal/air flow in a second flow direction substantially opposite to the first flow direction. The vanes of the first classifier cage define a static vane angle selected to direct the coal/air flow tangentially to the blades of the second classifier cage.

The first and second classifier cages each have a diameter, where the ratio of the diameter of the first classifier cage to the diameter of the second classifier cage is in the range of 1.2 to 3, and preferably in the range of 1.5 to 2.

The hybrid turbine classifier may also comprise a second cone disposed within the cavity of the first cone. The second cone extends upwardly from a base to a frustum, the outer surface of the second cone and the inner surface of the first cone defining an inner passage for the larger coal particles.

The rotor is rotatable in either the first flow direction or the second flow direction.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
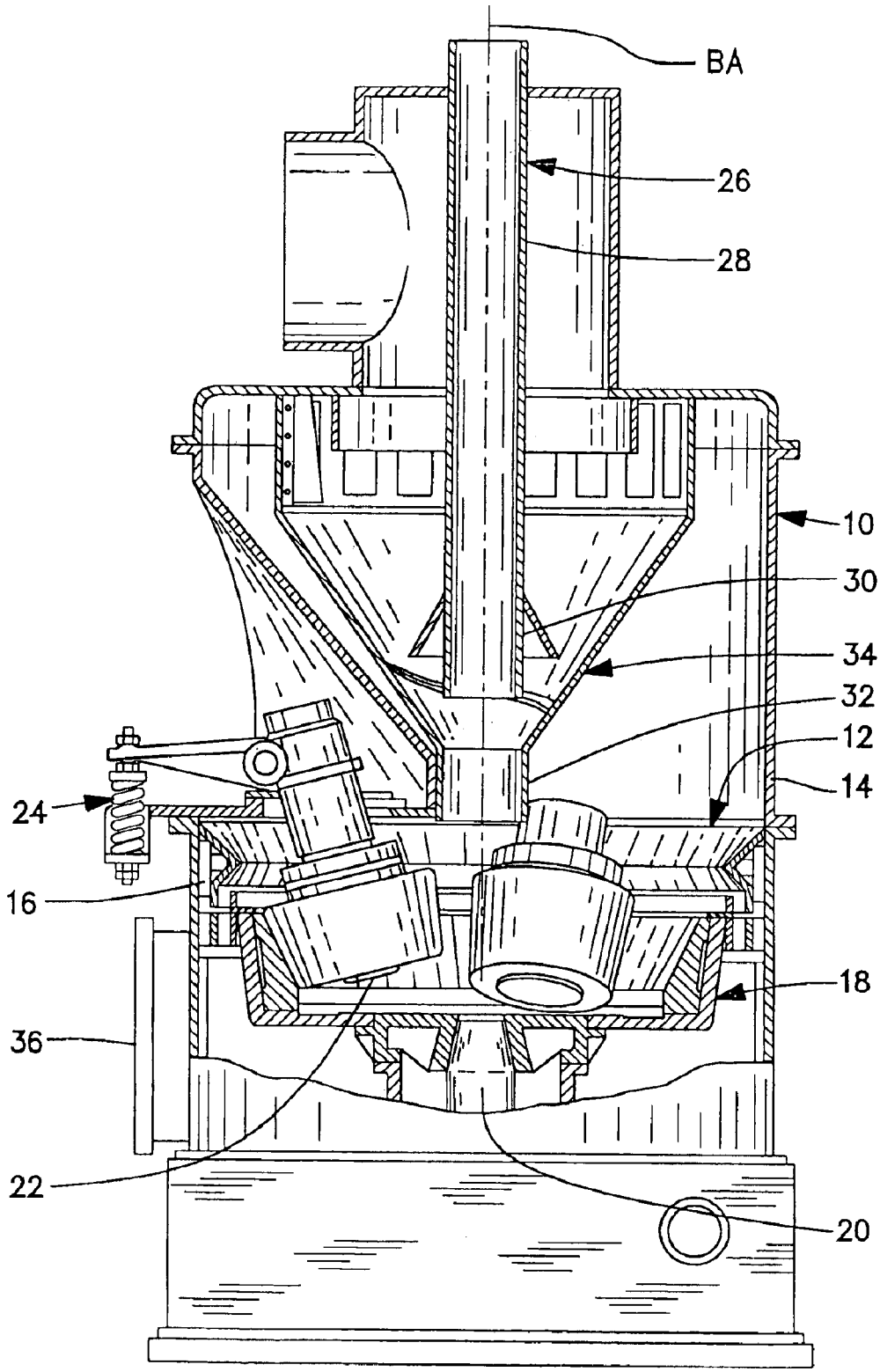
Figure 1 (PRIOR ART)
FIG. 1 is a front view in vertical section of a conventional pulverizer bowl mill.
Figure 2:
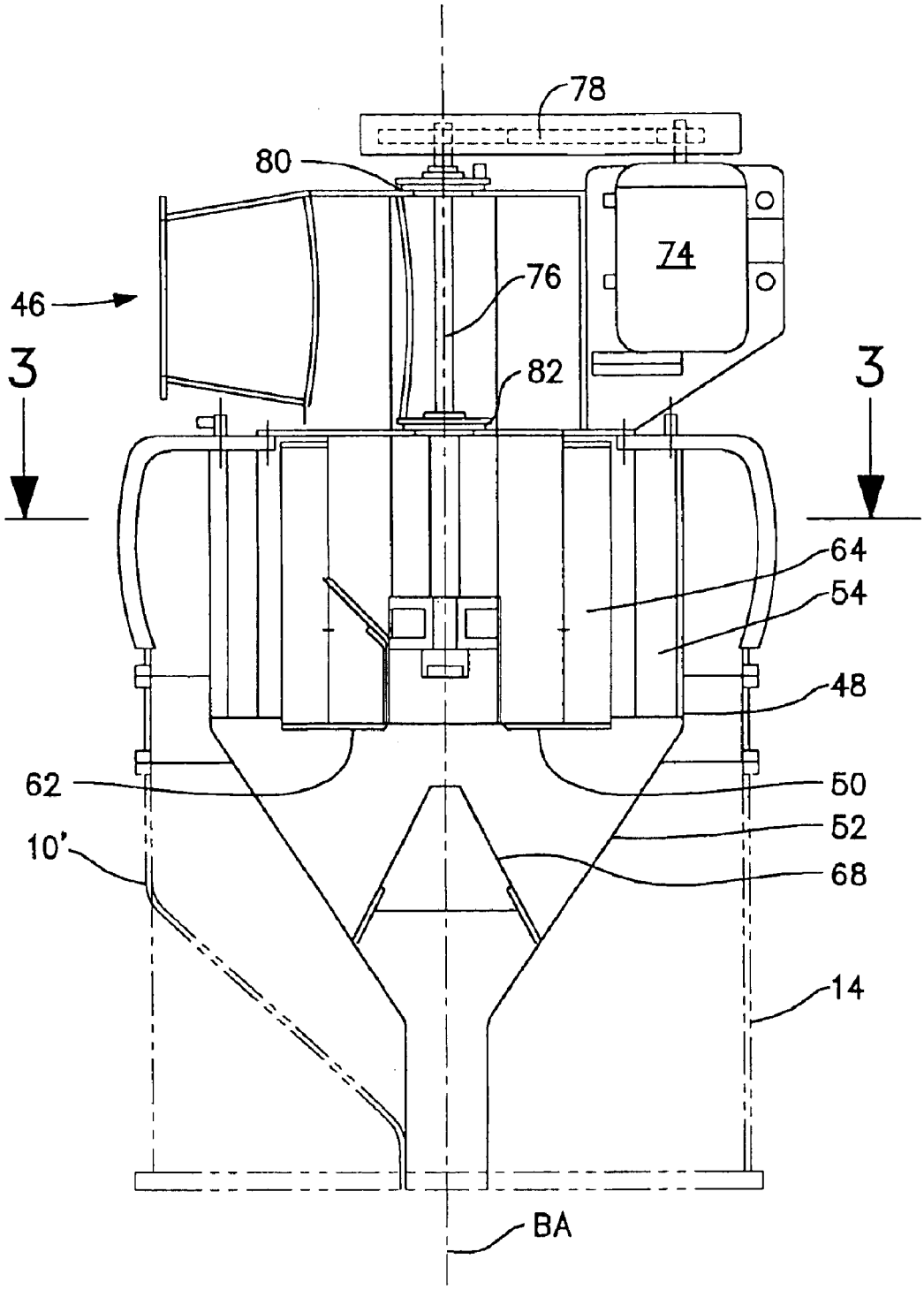
FIG. 2 is a front view in vertical section of the upper portion of a pulverizer bowl mill having a hybrid turbine classifier in accordance with the invention.

With reference to FIG. 1, a bowl mill 10 as illustrated therein includes a vane wheel assembly 12 and a substantially closed body portion comprised of a separator body 14 and a millside area 16. A grinding table 18 is mounted on a shaft 20, which in turn is operatively connected to a suitable drive mechanism (not shown) so as to be capable of being rotatably driven thereby. With the aforesaid components arranged within the closed body portion in the manner depicted in FIG. 1, the grinding table 18 is designed to be driven in a clockwise direction about a bowl mill axis BA defined by the axis of the shaft 20.

A plurality of grinding rolls 22, preferably three in number in accord with conventional practice, are suitably supported within the interior of the separator body 14 so as to be equidistantly spaced one from another around the circumference of the closed body portion. In the interest of maintaining clarity of illustration in the drawing, only two such grinding rolls 22 have been shown. With further regard to the grinding rolls 22, each is preferably supported on a shaft 24, which in turn is cooperatively associated with some form of biasing means.

The material, e.g. coal, that is to be pulverized in the bowl mill 10 is fed thereto by means of any suitable conventional form of feed means. By way of exemplification in this regard one such feed means that may be employed for this purpose is a belt feeder means (not shown). Upon being discharged from the feed means (not shown), the coal enters the bowl mill 10 by means of a coal supply means, generally designated by reference numeral 26, with which the closed body portion is suitably provided. In accordance with the embodiment of the bowl mill 10 illustrated in FIG. 1, the coal supply means 26 includes a suitably dimensioned duct 28 having one end thereof which extends outwardly of the closed body portion and preferably terminates in a funnel-like member (not shown). The latter member (not shown) is suitably shaped so as to facilitate the collection of the coal particles entering the bowl mill 10, and the guiding thereafter of these coal particles into the duct 28. The other end 30 of the duct 28 of the coal supply means 26 is operative to effect the discharge of coal onto the surface of the grinding table 18. To this end, as shown in FIG. 1, the duct end 30 preferably is suitably supported within the closed body portion through the use of any suitable form of conventional support means (not shown) such that the duct end 30 is coaxially aligned with the shaft 20 that supports the grinding table 18 for rotation, and is located in spaced relation to a suitable outlet 32 provided in the classifier, generally designated by reference numeral 34, through which the coal flows in the course of being fed onto the surface of the grinding table 18. Alternatively, coal may be fed from the side of the mill.

In accord with the mode of operation of bowl mills that embody the form of construction depicted in FIG. 1, a gas such as air is utilized to effect the conveyance of the coal from the grinding table 18 through the interior of the closed body portion for discharge from the bowl mill 10. The air that is used in this connection enters the millside area 16 through a suitable opening, denoted by the reference numeral 36, formed therein for this purpose. From the aforesaid opening 36 in the millside area 16 the air flows in surrounding relation from beneath the grinding table 18 to above the surface of the latter. More specifically, the air flows through a throat 38 formed between the inner wall surface of the millside area 16 and the circumference of the grinding table 18.

The air is made to flow through the interior of the bowl mill 10 and the coal which is disposed on the surface of the grinding table 18 is being pulverized by the action of the grinding rolls 22. As the coal becomes pulverized, the particles that result therefrom are thrown outwardly by centrifugal force away from the center of the grinding table 18. Upon reaching the region of the circumference of the grinding table 18, the coal particles are picked up by the air flowing upwardly from beneath the grinding table 18 and are carried away therewith. Thereafter, the stream of air with the coal particles entrained therein (or coal/air flow 40) follows a tortuous path through the interior of the bowl mill 10. Moreover, in the course of following this tortuous path a portion of the larger, heavier of the coal particles 42 are caused to be separated from the air stream in which they are entrained and are made to return to the surface of the grinding table 18 whereupon they undergo further pulverization. The remaining portion of the larger coal particles 42 and the smaller, lighter of the coal particles 44, on the other hand, continue to be carried along in the air stream. Ultimately, the combined stream of air and those coal particles that remain entrained therein flows to the classifier 34 to which reference has previously been had hereinbefore.

The classifier 34, in accord with conventional practice and in a manner which is well known to those skilled in this art, operates to effect a further sorting of the coal particles that remain in the air stream. Namely, those particles of pulverized coal 44, which are of the desired particle size, pass through classifier 34 and along with the air are discharged therefrom and thereby from the bowl mill 10. On the other hand, those coal particles 42 which in size are larger than desired, are returned to the surface of the grinding table 18 whereupon they undergo additional pulverization. Thereafter, these coal particles 42 are subjected to a repeat of the process described above.

In a hybrid turbine classifier 46 in accordance with the invention, the coal/air flow 40 passes through first and second classifier cages 48, 50, which remove the larger, heavier coal particles 42, not yet suitable for burning, from the air stream. The first classifier cage 48 defines a circumferential inlet into a classifier cone 52, located below the first and second classifier cages 48, 50, from the flow passage formed between the classifier cone 52 and the separator body 14. The first classifier cage has a plurality of circumferentially-spaced, static, vanes 54 which direct the coal/air flow 40 into the classifier cone 52 such that the coal/air spirals within the cone in a circular flow path 56 (FIG. 3), preferably clockwise when viewed from the top. The centrifugal flow tends to force another portion of the larger, heavier particles 42, outward against the sides of the static classifier cone 52, where they lose velocity and eventually drop out through the cone outlet 32 in the frustum of the cone 52 to the center of the grinding table 18 for regrinding. The air, carrying the smaller, lighter fines 44, and the remaining portion of the coarse particles 42 spirals inwardly toward bowl mill axis BA until it encounters the second classifier cage 50 which is disposed coaxially within the first classifier cage 48. The second classifier cage 50 defines a circumferential outlet out of the classifier cone 52. In order to have proper amount of annular space for particle separation, the ratio of the diameter 58 of the first classifier cage 48 to the diameter 60 of the second classifier cage 50 is preferably in the range of 1.2 to 3, more preferably in the range of 1.5 to 2.

The second classifier cage 50 has a rotor 62 carrying a plurality of circumferentially-spaced, blades 64. In a preferred embodiment, the blades 64 direct the coal/air flow 40 within the second classifier cage 50 along a flow path 66 having a direction which is opposite to the direction of the flow path 56 within the first classifier cage 48 when the incoming flow into the static vanes 54 is non-uniform. For example, if the vanes 54 directs the coal/air flow 40 in a clockwise direction, the blades 64 directs the coal/air flow 40 in a counter-clockwise direction. In this way, the coal/air flow 40 needs to change directions when it goes in between the blades 64. This change of flow direction causes substantially all of the remaining portion of coarse coal particles 42 to separate from the flow, thus achieving additional classification. In addition, the change of flow direction redistributes the coal particles in the outgoing flow, making coal/air mixture more uniform. This reduces the particle to particle interaction and the particle congestion and thus improves the particle separation efficiency.

The outer classifier cone 52 along with an inverted, inner cone 68 provide a passage for reject coarse coal particles 42 to return to the grinding table 18. The position of the inner cone 68 in the middle of the outer cone 52 minimizes the air flow inside the outer cone 52, facilitating separation of the reject coarse coal 42 particles from the bulk up-flow so that the coarse coal particles 42 can fall easily back to the grinding table 18

Figure 3:
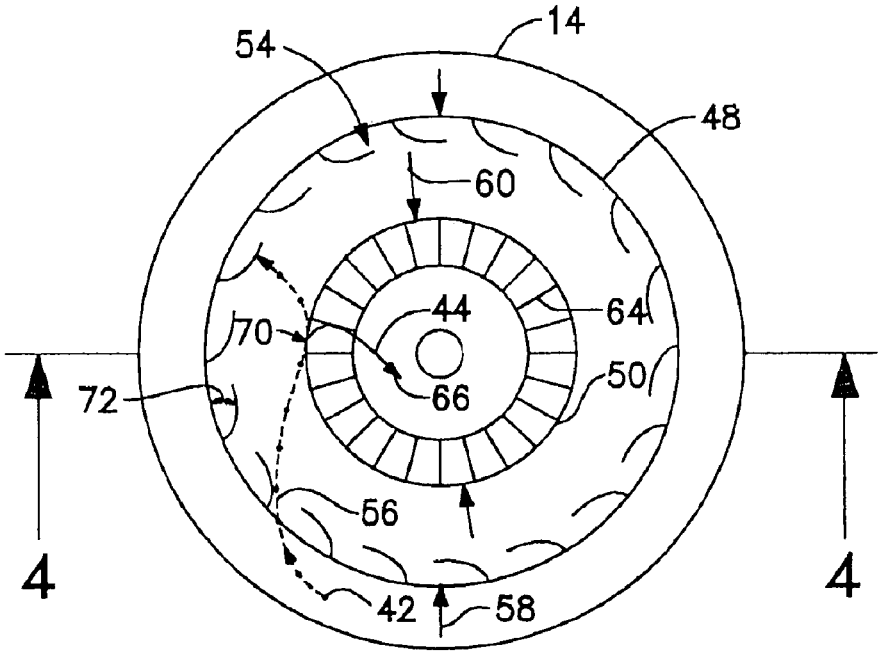
FIG. 3 is a simplified, schematic, cross-section view taken along line 3—3 of FIG. 2.
Figure 4:
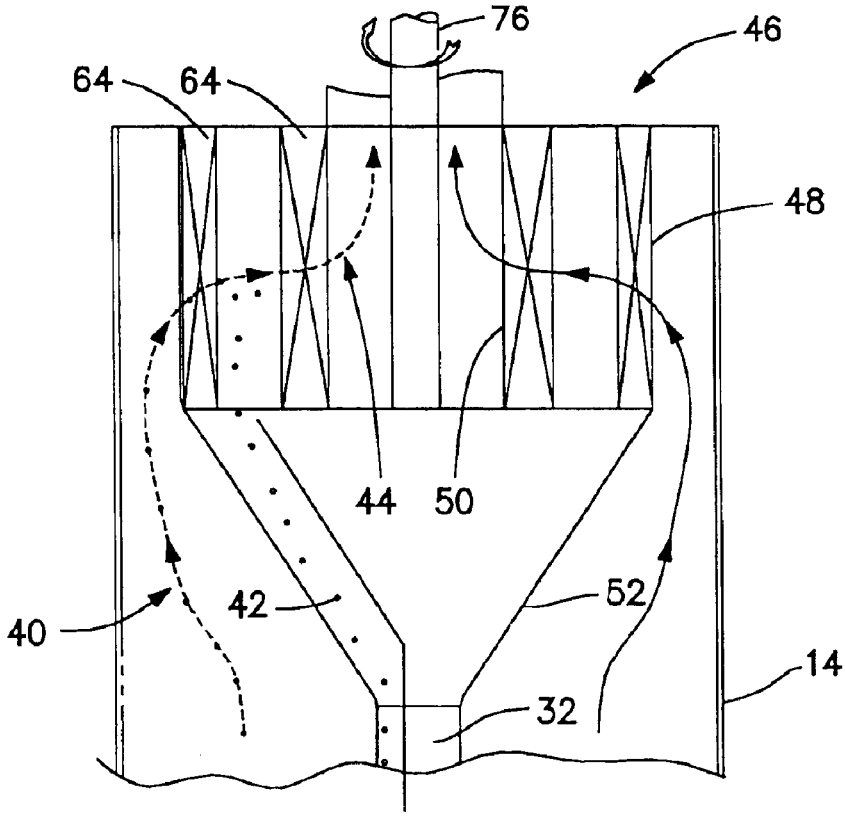
FIG. 4 is a cross-section view taken along line 4—4 of FIG. 3.

The first classifier cage 48 is designed such that the vanes 54 direct the flow in a direction tangential to the blades 64 (FIG. 3, at 70). This provides for the maximum change in flow direction when such flow is redirected by the blades 64 generating maximum centrifugal forces on the coal particles and thereby maximizing the particle separation. Based on the individual application and product requirements, the vane angle 72 required to provide tangential flow at the second classifier cage 50 depends on the incoming flow velocity and direction. The static vane angle 72 may be field adjustable to ensure the flow direction is tangential to the blades 64.

A motor 74 mounted at the top of the pulverizer may rotate the rotor 62 of the second classifier cage 50 in either the clockwise or the counterclockwise direction. The motor 74 is mechanically linked to a vertical drive shaft 76 by a drive belt 78, drive chain or other suitable means known in the art. The drive shaft 76 is coaxial with bowl axis BA and is supported by upper and lower bearings 80, 82. The rotor 62 is mounted to the lower end portion of the drive shaft 76.

It should be appreciated that the amount of power required to rotate the rotor 62 in the direction which is opposite to the circular flow path 56 of the coal/air flow 40 is greater than the amount of power required to rotate the rotor 62 in the same direction as circular flow path 56, since the coal/air flow 40 opposes such rotation. More specifically, if the coal/air flow 40 spirals in the clockwise direction, it takes more power to rotate rotor 62 in the counterclockwise direction than it does to rotate rotor 62 in the clockwise direction, thereby resulting in greater operating costs. Depending on the specific installation and the capabilities of commercially available motors, a motor 74 which must rotate rotor 62 in the opposite direction of flow path 56 (or which must be capable of doing so) may have to be larger than a motor 74 for the same installation which is required to rotate rotor 62 only in the same direction as flow path 56, thereby resulting in greater construction costs. However, rotating the rotor 62 of the second classifier cage 50 in the direction opposite of flow path 56 provides greater classification of the coal than can be achieved by rotating rotor 62 in the direction of flow path 56. Accordingly, the choice of the direction of rotation is dependent on several variables.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. In a hybrid turbine classifier for a coal pulverizer having a separator body, means for supplying raw coal into said separator body, a grinding table disposed in said separator body for grinding the raw coal into coal particles, and means for supplying an air flow between said grinding table and said separator body, the air flow carrying a mixture of larger and finer coal particles upward from said grinding table to form a coal/air flow, said hybrid turbine classifier comprising: a first cone disposed within said separator body, said first cone extending downwardly from a base to a frustum defining an opening adapted for depositing coal particles on said grinding table, said first cone having inner and outer surfaces, said inner surface of said first cone defining a cavity, said outer surface of said first cone and said separator body defining an outer passage for the coal/air flow, said hybrid turbine classifier further comprising: a circular first classifier cage disposed proximate to the base of said first cone, said circular first classifier cage defining an axis and a circumferential passage between the outer passage defined by the outer surface of said first cone and said separator body and the cavity of said first cone, said circular first classifier cage including a plurality of static, circumferentially-spaced vanes directing the coal/air flow in a spiraling, circular flow path defining a first flow direction within the cavity of said first cone, and said hybrid turbine classifier further comprising: a circular second classifier cage coaxially disposed within said circular first classifier cage, said circular second classifier cage including a rotor rotatable around the axis defined by said circular first classifier cage and defining a circumferential outlet from the cavity of said first cone, said rotor of said circular second classifier cage having a plurality of circumferentially-spaced blades directing the coal/air flow in a second flow direction substantially opposite to the first flow direction of the coal/air flow within the cavity of said first cone, the improvement comprising:

said plurality of static, circumferentially-spaced vanes of said circular first classifier cage define a static vane angle selected to direct the coal/air flow tangentially to said plurality of circumferentially-spaced blades of said rotor of said circular second classifier cage and along the flow path defining the first flow direction within the cavity of said first cone such that contact of the coal/air flow with said plurality of circumferentially-spaced blades of said rotor of said circular second classifier cage acts to redirect the coal/air flow into the second flow direction substantially opposite to the first flow direction of the coal/air flow within the cavity of said first cone such that this change in flow direction causes substantially the remaining portion of the larger coal particles to separate from the coal/air flow thereby achieving additional classification of the coal particles;

said circular first classifier cage and said circular second classifier cage each have a diameter such that in order to provide for the proper amount of coal particle separation from the coal/air flow the ratio of the diameter of said circular first classifier cage to the diameter of said circular second classifier cage is in the range of 1.2 to 3.0; and a second cone disposed within the cavity of said first cone, said second cone extending upwardly from a base to a frustum, said second cone having an outer surface, said outer surface of said second cone and said inner surface of said first cone defining an inner passage for the rejected larger coal particles such that the inner passage is operable to facilitate the separation of the rejected larger coal particles from the coal/air, flow so that the rejected larger coal particles can fall more easily on to said grinding table for further pulverization.

2. In the hybrid turbine classifier of claim 1, the improvement wherein in order to provide for the proper amount of coal particle separation from the coal/air flow the ratio of the diameter of the circular first classifier cage to the diameter of the circular second classifier cage is in the range of 1.5 to 2.0.

3. In the hybrid turbine classifier of claim 1, the improvement wherein each of said plurality of static, circumferentially-spaced vanes of said circular first classifier cage is field adjustable in order to thereby permit the selection of the proper static vane angle.

* * * * *